US006292070B1

(12) United States Patent
Merrill

(10) Patent No.: US 6,292,070 B1
(45) Date of Patent: Sep. 18, 2001

(54) BALUN FORMED FROM SYMMETRICAL COUPLERS AND METHOD FOR MAKING SAME

(75) Inventor: Jeffrey Craig Merrill, Manlius, NY (US)

(73) Assignee: Anaren Microwave, Inc., Syracuse, NY (US)

( * ) Notice: Subject to any disclaimer, the term of this patent is extended or adjusted under 35 U.S.C. 154(b) by 0 days.

(21) Appl. No.: 09/491,449

(22) Filed: Jan. 26, 2000

Related U.S. Application Data

(63) Continuation-in-part of application No. 09/266,564, filed on Mar. 11, 1999.

(51) Int. Cl.[7] ..... H01P 5/10

(52) U.S. Cl. ..... 333/26; 333/25; 343/859

(58) Field of Search ..... 333/25, 26; 343/859

(56) References Cited

U.S. PATENT DOCUMENTS 3,991,390 * 11/1976 Conroy ..... 333/26
6,133,806 * 10/2000 Sheen ..... 333/26
6,150,897 * 11/2000 Nishikawa et al. ..... 333/26

* cited by examiner

*Primary Examiner*—Justin P. Bettendorf
*Assistant Examiner*—Dean Takaoka
(74) *Attorney, Agent, or Firm*—Bond, Schoeneck & King, LLP

(57) ABSTRACT

A balun includes first and second symmetrical couplers, preferably first and second backward wave couplers connected to form a balun having an unbalanced port and a balanced port. More specifically, a balun in accordance wit this invention includes first and second backward wave symmetrical couplers each having an input port, a direct port, coupled port, and an isolate port in which the input port of a first coupler is connected to an input port of the second coupler, and the isolated port of the first coupler and the direct port of the second coupler are connected to the balanced ports of the balun respectively.

34 Claims, 6 Drawing Sheets

Z0=28.41, Z0en=3.5, Zs=50, Zb=25

Z0=25, Z0en=3.5, Zs=50, Zb=25

ZO=21.65, ZOen=2.414, Zs=50, Zb=3.75

ZO=30.62, ZOen=2.414, Zs=50, Zb=75

ZO=43.3, ZOen=2.414, Zs=50, Zb=150

BALUN FORMED FROM SYMMETRICAL COUPLERS AND METHOD FOR MAKING SAME

CROSS REFERENCE TO RELATED APPLICATIONS

This application is a continuation-in-part of application Ser. No. 09/266,564 filed Mar. 1, 1999.

FIELD OF THE INVENTION

This invention relates generally to transformers for coupling a balanced RF circuit to an unbalanced RF circuit (balun) and more particularly to a balun formed from first and second symmetrical couplers, preferably symmetrical backward wave couplers, and a method for designing such balun to produce desired combinations of input and output impedance, and band width utilizing theoretically valid techniques.

BACKGROUND OF THE INVENTION

A balun is a passive electronic circuit that can be used for conversion between symmetrical (balanced) and non-symmetrical (unbalanced) transmission lines.

At low frequencies, and less frequently at high frequencies, a variety of constructions are used to form baluns. For example, coaxial transmission line segments can be used to form baluns. A quarter wave length of coaxial cable having its outer conductor grounded at a single ended side, and an input applied to the single ended end of the quarter wave length cable will produce a balanced output between the cable conductors at the opposite end of the cable. A balanced signal applied to the non-grounded end will produce a single ended output at the grounded end.

Printed circuit forms of baluns have also been used. In U.S. Pat. No. 4,193,048 a balun transformer made from stripline elements formed on a printed circuit board is described. The balun transformer is fabricated from a pair of conductors each having first and second ends located on opposite sides of the printed circuit board. The first end of each conductor is located adjacent its second end.

U.S. Pat. No. 5,061,910 attempts to provide an improved printed circuit balun that includes a plurality of serially connected first conductor elements, preferably a contiguous merged conductor extending between a single ended signal port and ground, and a plurality of second conductor elements, also preferably in the form of a contiguous merged conductor coupled to the first conductor elements and electrically isolated therefrom, the second conductor elements extending in electrical symmetry from ground to a balanced port, the first and second conductor elements being separated by an electrical isolation layer, preferably the dielectric layer of the printed circuit board.

U.S. Pat. No. 5,697,088 describes a more recent configuration of stripline elements to form a balun useful at very high frequencies.

U.S. Pat. No. 5,644,272 shows a balun having both distributed (stripline) elements and discrete elements combined in a multi-layer dielectric structure.

Baluns including coaxial cable and wave guide, microwave circuits such as strip lines and micro strips, and other constructions are known to those skilled in the art. For the most part, known balun configurations are limited to certain specific impedance transformations such as one-to-one baluns at useful characteristic impedances such as 50 ohms and 75 ohms, two-to-one impedance transformations and the like. Teretofore,we believe that no method has been known for producing baluns having impedance transformation characteristics other than those certain values produced by those known configurations just mentioned. There is a need for baluns that match specific input and output impedances produced by transistor amplifiers, antenna splitters and combiners, and the like, that are not met by known balun constructions.

It is an object of this invention to provide a balun formed from a pair of symmetrical couplers, preferably symmetrical backward wave couplers, that can provide desired combinations of bandwidth and impedance transformation over useful ranges, so that substantially exact matching between balanced and unbalanced circuits can be produced.

It is another object of this invention to provide such a balun that can be implemented in a variety of forms including micro-strips and strip lines useful over a wide range of frequencies including microwave frequencies.

It is another object of this invention to provide a method for determining the characteristics, specifically the characteristic impedance and the normalized even mode impedance for symmetrical couplers to produce the desired combinations of band widths, operating frequency and impedance matching in a balun in accordance with the invention.

Briefly stated, and in accordance with a presently preferred embodiment of the invention, a balun includes first and second symmetrical couplers, preferably first and second backward wave couplers connected to form a balun having an unbalanced port and a balanced port. More specifically, a balun in accordance with this invention includes first and second backward wave symmetrical couplers each having an input port, a direct port, coupled port, and an isolated port in which the input port of a first coupler is connected to the unbalanced port of the balun, the coupled port of the first coupler is connected to an input port of the second coupler, and the isolated port of the first coupler and the direct port of the second coupler are connected to the balanced ports of the balun respectively.

In accordance with another aspect of the invention, the direct port of the first coupler and the coupled port and the isolated port of the second coupler are connected to ground.

In accordance with another aspect of the invention, the first and second symmetrical couplers are substantially identical.

A method in accordance with the invention for providing a balun having a desired unbalanced port impedance and a desired balance port impedance includes the steps of selecting a desired balanced port impedance; selecting a desired unbalanced port impedance; determining the achievable normalized even mode impedance for the type of couplers to be used in the balun; calculating f(Z0en) for the type of coupler used in the balun; calculating Z0m for the coupler and then fabricating the first and second symmetrical couplers defined by Z0en and Z0m.

BRIEF DESCRIPTION OF THE DRAWINGS

The novel aspects of this invention are set forth with particularity in the appended claims. The invention itself, together with further objects and advantages thereof, may be more readily comprehended by reference to the following detailed description of a presently preferred embodiment of the invention taken in conjunction with the accompanying drawing, in which:

DETAILED DESCRIPTION OF THE PREFERRED EMBODIMENTS

Figure 1:
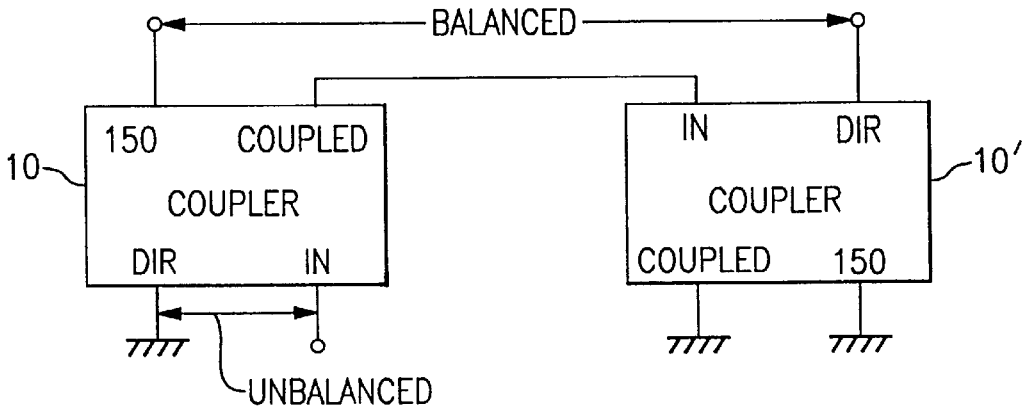
FIG. 1 is a block diagram of a balun formed from symmetrical couplers in accordance with this invention.
Figure 2:
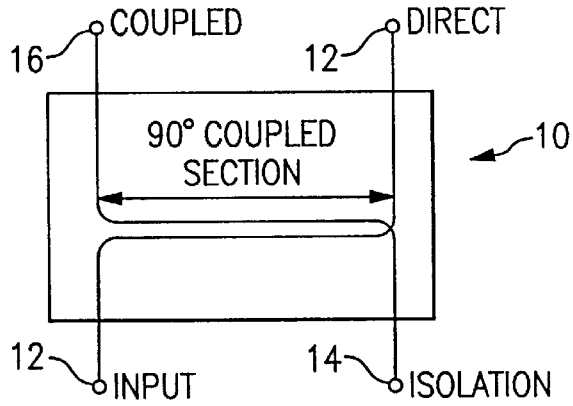
FIG. 2 is a block diagram of a symmetrical coupler for use in a balun in accordance with this invention that includes two strip line symmetrical couplers.

FIG. 1 is a block diagram of a balun in accordance with this invention;

FIG. 2 is a more detailed diagram of a symmetrical backward wave coupler of the type useful in the arrangement of FIG. 1.

Referring first to FIG. 2, a backward wave coupler 10 of the type usefully employed in this invention is a four port device characterized by a fixed 90 degree phase shift between the output ports. Depending on the application in which they are employed, couplers of this type are sometimes referred to as either "directional" or "3 dB hybrid" couplers. These two terms refer to fundamentally the same type of coupler.

FIG. 2 is a schematic diagram of a circuit of a backward wave coupler useful in a balun in accordance with this invention. The ports of the coupler are identified as the input port 12, isolation port 14, coupled port 16 and direct port 18 respectively. Those skilled in the art will recognize that the naming is somewhat arbitrary, inasmuch as the backward wave coupler 10 is symmetrical and any port can be chosen as the input port, with the others renamed accordingly.

The direct port 18 is so named because it is "DC" coupled to the input port 12. The coupled port 16 is "AC" coupled to the input port 12 and there is no direct connection between the input port 12 and the coupled port 16. The isolation port 14 is DC coupled to the coupled port 16, and AC coupled to the direct port 18.

$$\begin{bmatrix} E_{1s} \\ E_{2s} \\ E_{3s} \\ E_{4s} \end{bmatrix} = \begin{bmatrix} S_{11} & S_{12} & S_{13} & S_{14} \\ S_{21} & S_{22} & S_{23} & S_{24} \\ S_{31} & S_{32} & S_{22} & S_{34} \\ S_{41} & S_{42} & S_{43} & S_{44} \end{bmatrix} \begin{bmatrix} E_{1i} \\ E_{2i} \\ E_{3i} \\ E_{4i} \end{bmatrix}$$

Where:

$E_{ki}$=Voltages applied to ports 1 to 4

$E_{ks}$=Voltages received at ports 1 to 4 with Eki applied $S_{kj}$=Coupler complex scattering coefficients Because the input and output ports can be interchanged with no observable change in the relationship to the other ports, the 16 scattering co-efficients can be reduced to four, and the scattering matrix can be expressed as $$S_{kj} = \begin{bmatrix} S_{11} & S_{21} & S_{31} & S_{41} \\ S_{21} & S_{11} & S_{41} & S_{31} \\ S_{31} & S_{41} & S_{11} & S_{21} \\ S_{41} & S_{31} & S_{21} & S_{11} \end{bmatrix}$$

Even and odd mode analysis is used to determine the four coefficients $S_{11}$, $S_{21}$, $S_{31}$, and $S_{41}$. A coupler can be represented by independent even and odd modes, and the final results are obtained by superimposing the two modes. The two modes are characterized by different impedances, $Z_{oe}$ for the even mode and $Z_{oo}$ for the odd mode. For an ideal coupler having perfect match and isolation, the product of the even and odd mode impedances must equal the square of the coupler characteristic impedance, and the propagation constant of the even and odd modes must be identical. The even and odd modes must have the same velocity through the coupled region.

Condition 1: $Z_{oe}Z_{oo}=Z_o^2$

Condition 2: $\beta_{even}=\beta_{odd}$

Where:

$Z_{oe}$=Coupler even mode impedance $Z_{oo}$=Coupler odd mode impedance $Z_o$=Coupler input and output impedance $\beta_{even}$=Coupler even mode propagation constant $\beta_{odd}$=Coupler odd mode propagation constant When these conditions are met, the scattering coefficients $S_{11}$, $S_{12}$ must be equal to zero and the scattering coefficients $S_{31}$ and $S_{41}$ are given by:

$S_{31}=j\mathrm{Sin}\theta e^{-j(\beta l+\epsilon)}$ $S_{41}=\mathrm{Cos}\theta e^{-j(\beta l+\epsilon)}$ Where:

$$\beta = \frac{2\pi}{\lambda}$$

is this coupler propagation constant l=coupler electrical length in wavelengths $\epsilon$=a small dispersion term and where $\theta$, the coupling angle is given by the expression;

$$\theta = \tan^{-1}\left[\frac{1}{2}\left(\frac{Z_{oe}}{Z_o} - \frac{Z_{oo}}{Z_o}\right)\sin\beta l\right]$$

with Condition 1 ($Z_{oe}Z_{oo}=Z_o^2$), this equation reduces to:

$$\theta = \tan^{-1}\left(\frac{1}{2}\left(Z'_{oe} - \frac{1}{Z'_{ow}}\right)\sin\beta l\right)$$

where $$Z'_{oe} = \frac{Z_{oe}}{Z_o}$$

(the normalized even mode impedance)

Note the fixed 90° phase shift term (j) between $S_{31}$ and $S_{41}$. This is a frequency independent term which is characteristic of all backward wave couplers; the coupled output port is always 90° out of phase with the DC output port.

The dispersion term $\epsilon$ is a small group delay term which can normally be neglected since it does not affect the relative phase shift between output ports. This small dispersion term does become important (and must be accounted for) in large, multiple coupler networks containing odd numbers of couplers where phase is important. The backward wave coupler is a fast wave structure (due to the dispersion term $\epsilon$) and slow wave structures (e.g. Shiffman phase shifters) must be used to compensate for this dispersion.

In a balun according to this invention, the effects of ; are negligible and the complete scattering matrix for a matched coupler becomes:

$$S_{kj} = \begin{bmatrix} 0 & 0 & j\sin\theta & \cos\theta \\ 0 & 0 & \cos\theta & j\sin\theta \\ j\sin\theta & \cos\theta & 0 & 0 \\ \cos\theta & j\sin\theta & 0 & 0 \end{bmatrix} e^{-j\beta l}$$

and the equations for scattered voltages with port 1 excited reduce to:

$E_{31}$(coupled port)=$j\sin\theta e^{-j\beta l}$ $E_{41}$ (DC port)=$\cos\theta e^{-j\beta l}$ The power to the output ports as a function of the coupling angle ($\theta$), normalized even mode impedance ($Z_{oe}$) and electrical coupler length ($\beta 1$) are given by the following $$P_{(Coupled\ Port)} = \sin^2\theta = \frac{\left(Z'_{oe} - \frac{1}{Z'_{oe}}\right)^2 \sin^2\beta l}{4 + \left(Z'_{oe} - \frac{1}{Z'_{oe}}\right)^2 \sin^2\beta l} = \frac{4}{4 + \left(Z'_{oe} - \frac{1}{Z'_{oe}}\right)^2 \sin^2\beta l}$$

$$P_{(DC\ Port)} = \cos^2\theta$$

Figure 15:
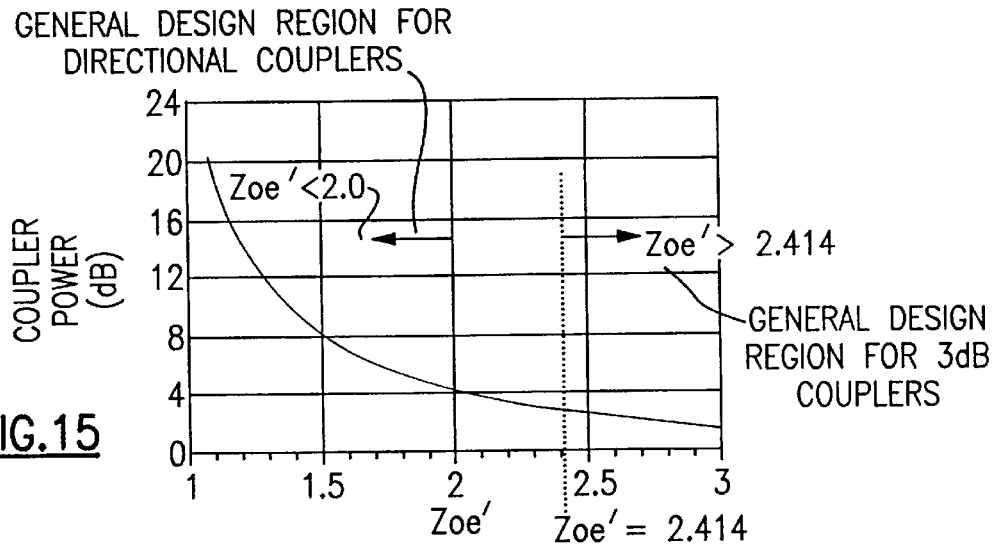
FIG. 15 is a graphical representation of power to the coupled port vs. Zoe for a backward wave coupler at band center.

FIG. 15 shows how power varies to the coupled port as a function of normalized even mode impedance ($Z_{oe}$) at center frequency. The region close to an even mode impedance of 2.5 is referred to as a 3 dB coupler and a 3 dB coupler is considered "critically" coupled with $Z_{oe}'$=2.414 and "over coupled" with $Z_{oe}'$ greater than 2.414. For values of $Z_{eo}'$ less than approximately 2.0, the coupler is considered a "directional coupler.

Figure 16:
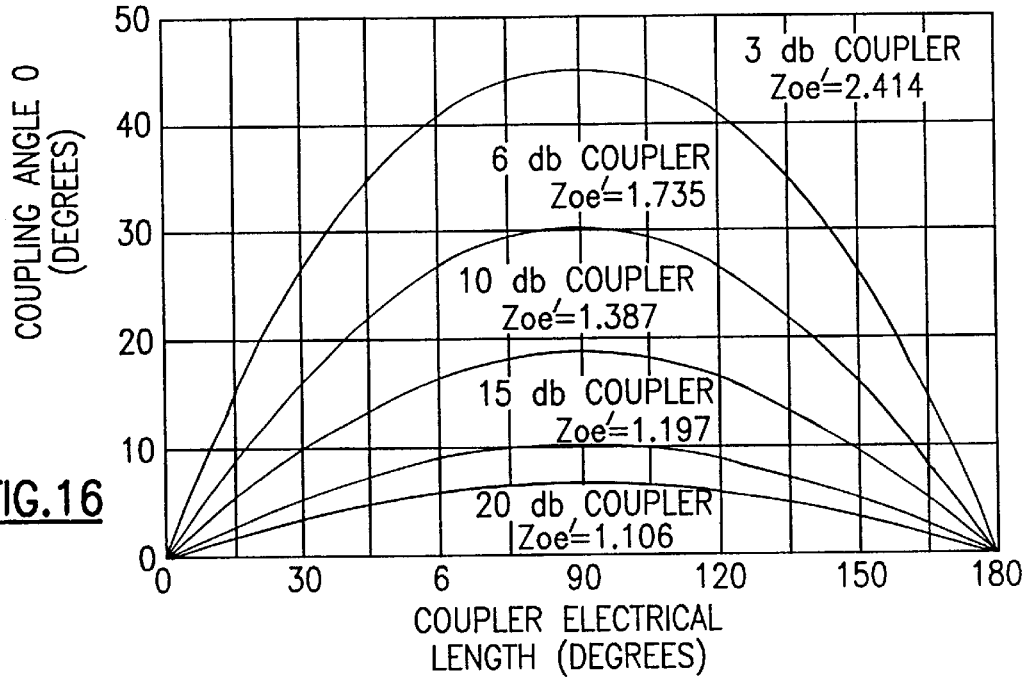
FIG. 16 is a graphical representation of coupling angle vs coupler electrical length.

FIG. 16 illustrates the variation of coupling angle ($\theta$) vs coupler electrical length for various values of even mode impedance. The functions are periodic with frequency; a 3 dB coupler couples one half power to each output at its fundamental frequency ($\beta 1$ is 90°) and at odd multiples of this ($\beta 1$=270° and etc.).

Figure 5:
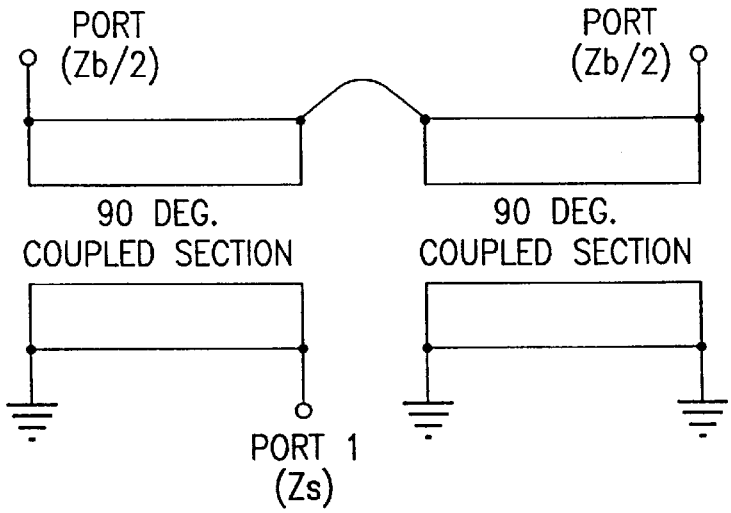
FIG. 5 is a schematic diagram of a three port balun in accordance with the invention.

The schematic shown in FIG. 5 shows the interconnections between two couplers 10 to form a balun. To help simplify the analysis, this illustration intentionally omits parasitic elements that are due to interconnection or packaging. These elements must be considered when implementing this design into a packaged product. However, because the parasitics associated with physical implementation may vary depending on the type of structure that is used (i.e. stripline, microstrip, coax, waveguide, etc.), these issues are not discussed here. Consideration of these parasitic elements is within the capabilities of one of ordinary skill in the art.

As can be seen in the schematic representation of FIG. 1, the circuit is preferably comprised of two equivalent couplers which both have a characteristic impedance of Z0. After shorting three of the ports and making the coupler interconnection we are left with three ports. This three port device (with all three ports referenced to ground) has the following S-parameter matrix at center frequency when Z0 is such that port one is matched:

$$S^t = \begin{bmatrix} S^t11 & S^t12 & S^t13 \\ S^t21 & S^t22 & S^t23 \\ S^t31 & S^t32 & S^t33 \end{bmatrix} \begin{bmatrix} 0 & j/\sqrt{2} & -j/\sqrt{2} \\ j/\sqrt{2} & \frac{1}{2} & \frac{1}{2} \\ -j/\sqrt{2} & \frac{1}{2} & \frac{1}{2} \end{bmatrix}$$

The following equalities are valid at all frequencies. The proof of these statements is obtained using flow graph theory and applying Mason's rule:

$$S^t22=S^t33 \quad (1)$$

$$S^t23=S^t32 \text{ (Reciprocity)} \quad (2)$$

$$S^t21=-S^t31 \text{(equal amplitude and 180 degree phase difference)} \quad (3)$$

$$|S^t22+S^t32|=1 \quad (4)$$

Figure 3:
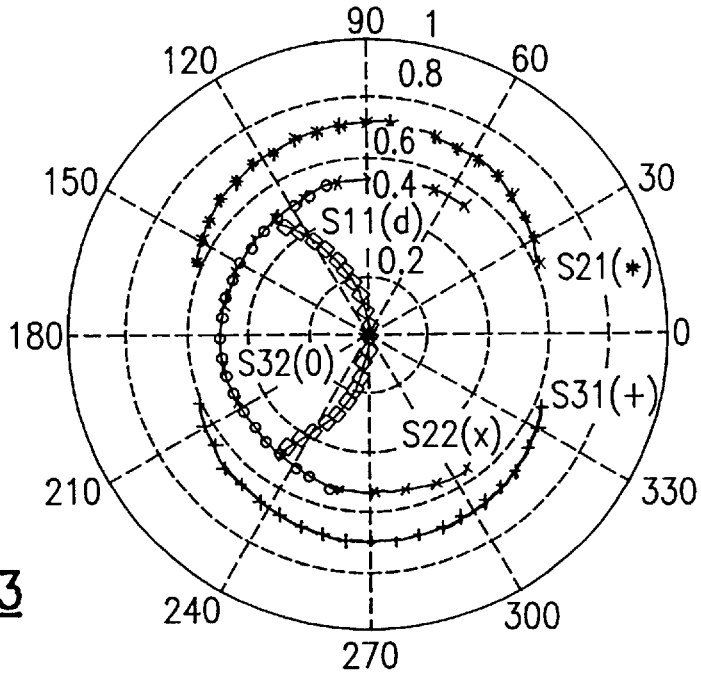
FIG. 3 is an S parameter plot over a 3:1 bandwidth with port 1 set to 50 ohms.
Figure 4:
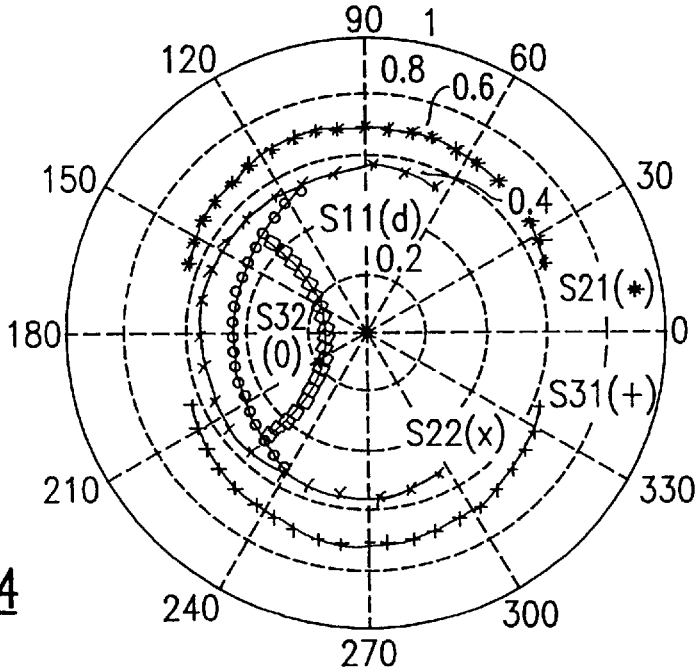
FIG. 4 is an S parameter plot similar to FIG. 3 but with Z0=28.41 ohms.

Equations (3) and (4) have been confirmed by simulation. The $S^t$-parameters are plotted over a 3:1 bandwidth in FIGS. 3 and 4. In FIG. 3, the unbalanced port is set to 50 Ohms, the balanced ports are set to 12.5 Ohms (25 Ohm balanced termination), the coupler normalized even mode impedance is set to 3.5 and coupler characteristic impedance is calculated as described below to be 28.41 Ohms. These conditions yield perfect match at port 1 at center frequency. The normalized even mode impedance Z0en =Z0e/Z0=Z0/Z0o where Z0e and Z0o are even and odd mode impedances .

Thiese equations are also valid when the ports are not perfectly matched. To illustrate this fact, Z0 is changed from 28.41 Ohms to 25 Ohms. Port impedances and normalized even mode impedance will remain the same. The $S^t$-parameters of equations (3) and (4) are again plotted in FIG. 4 for this new condition. Notice that $S^t22$ and $S^t32$ have both changed but equation (4) is still valid. Changes in $S^t21$ and $S^t31$ are difficult to see but have occurred and equation (3) is still valid.

Figure 6:
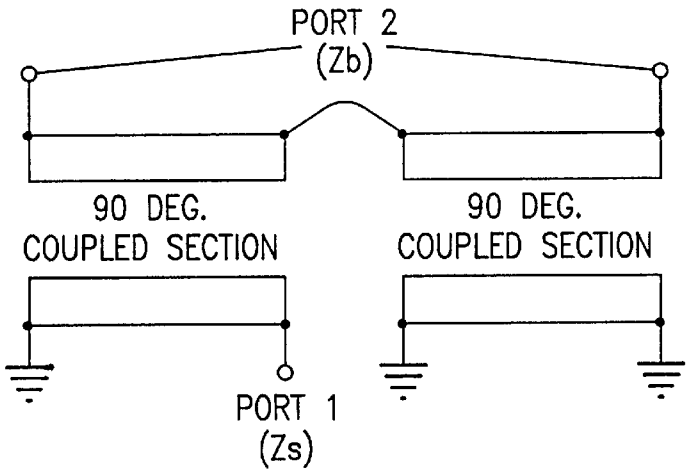
FIG. 6 is a schematic diagram of a two port balun in accordance with the invention.

Given the above equalities, the circuit can now be reduced from a three port network to a two port network as shown in FIG. 6, with port 1 remaining the single ended port and ports 2&3 being combined to be the balanced port. The combining of ports 2&3 to yield a single balanced port is mathematically illustrated below. Because this is a balanced port there will be a differential and a common mode solution. Both are solved below although only the differential solution will exist in our analysis of this balun circuit. This is driven by the above equality $S^t21=-S^t31$.

$$b2=a2*S^t22+a3*S^t23 \quad (5)$$

$$b3=a3*S^t33+a2*S^t32 \quad (6)$$

For differential mode: a2=½ and a3=(−½)

$$S^d22=\Gamma_{diff}=\frac{b2-b3}{a2-a3} \quad (7)$$

$$=\frac{\left(\frac{1}{2}*S^t22+\left(-\frac{1}{2}\right)*S^t23\right)-\left(\left(-\frac{1}{2}\right)*S^t33+\frac{1}{2}*S^t32\right)}{\frac{1}{2}-\left(-\frac{1}{2}\right)}$$

$$=\frac{1}{2}(S^t22+S^t33)-\frac{1}{2}(S^t23+S^t32)$$

For common mode: a2=½ and a3=½

$$\Gamma_{com}=\frac{b2+b3}{a2+a3} \quad (8)$$

$$=\frac{\left(\frac{1}{2}*S^t22+\frac{1}{2}*S^t23\right)+\left(\frac{1}{2}*S^t33+\frac{1}{2}*S^t32\right)}{\frac{1}{2}+\frac{1}{2}}$$

$$=\frac{1}{2}(S^t22+S^t33)+\frac{1}{2}(S^t23+S^t32)$$

And based on equations (1) & (2) we can reduce further to:

$$S^d22=\Gamma_{diff}=S^t22-S^t32 \quad (9)$$

$$\Gamma_{com}=S^t22+S^t32 \quad (10)$$

$$S^d21=S^t21*2^{1/2} \text{ given equation (3)} \quad (11)$$

And finally, port 1 remains unchanged in the conversion yielding:

$$S^d11=S^t11 \quad (12)$$

Figure 8:
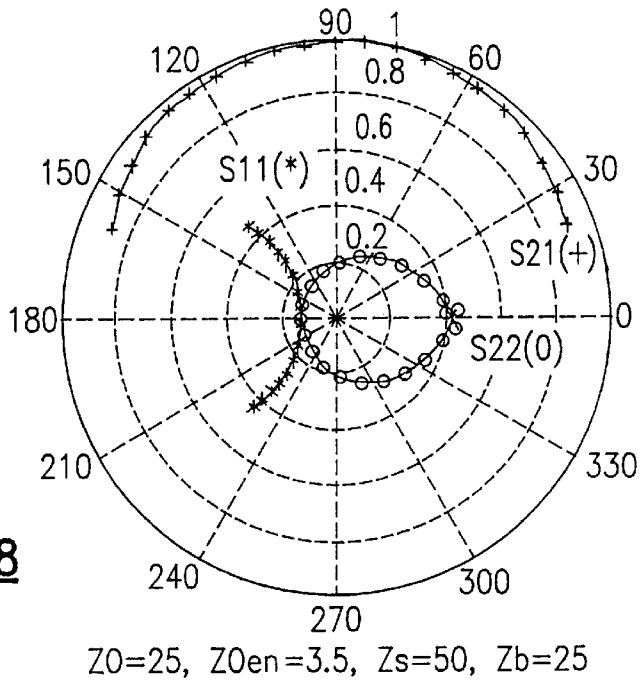
FIGS. 7 and 8 are plots of Sd11, Sd22 and Sd21 for the same conditions as were used in FIGS. 3 and 4
Figure 7:
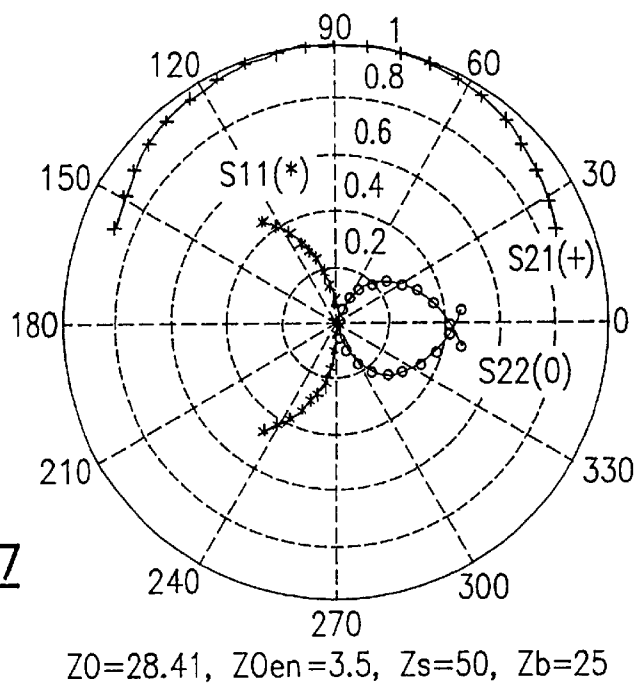

Taking the absolute value of both sides of equation (10) and substituting from equation (4), we see that $|\Gamma_{com}|$ is always 1. In other words, ideally there is maximum reflection for the common mode component. If we analyze this as a lossless two port device the $S^d$-parameter matrix is unitary by definition. This is a reciprocal device so we can state that $S^d21=S^d12$. This leads to $|S^d11|=|S^d22|$. Plots of $S^d11$, $S^d22$ and $S^d21$ can be seen in FIGS. 7 and 8 for the same conditions that were used in FIGS. 3 and 4.

Again, these illustrations show that the equalities hold with Z0 selected for matched conditions at the center frequency as well as when Z0 is selected to provide mismatched conditions. In summary, a special property of this device is it's ability to produce signals at ports 2 and 3 (as shown in FIG. 5) that are equal in amplitude and 180 degrees out of phase. This property allows for the device to be reduced to a two port network for further analysis.

Also noteworthy at this point is the balanced port termination technique. As illustrated in FIG. 6, a termination is placed between the two output terminals. TIhis is where a balanced load would be placed. An equivalent balanced port termination can be achieved by using two single ended terminations. Each of these terminations would have a value of Z0/2 Ohms and one would be placed from port 2 to ground and the other from port 3 to ground (see FIG. 5). For example, if the network is designed so that the single ended port is matched to 50 Ohms when the balanced port is terminated with 25 Ohms, the single ended port will also be matched when 12.5 Ohm terminations are placed from each of the two balanced port terminals to ground. Thus, this device can be used to drive two single ended loads with equal anplitude and 180 degree phase difference as well as balanced loads.

A coupler for use in a balun in accor dance with the invention is selected in accordance with the following method. The analysis will be based upon characterizing the balun as a two port device. First is the single ended (referenced to ground) port labeled port 1 in FIGS. 5 and 6. The impedance of this port will be assigned the variable name Zs. Second is the balanced port which is the combination of ports 2 and 3 as illustrated in FIG. 6. The impedance of this port will be assioned the variable name Zb. These and other variables that will be used are outlined in the followinga table:

| Variable Name | Description |
|---|---|
| Zs | Single ended port impedance. |
| Zb | Balanced port impedance |
| Z0 | Coupler characteristic impedance. |
| Z0m | The value of Z0 that provides perfect port match at center frequency. |
| Z0en | The normalized (to Z0) even mode impedance. |

As mentioned earlier, the purpose of this device is to provide a transformation from a balanced to an unbalanced (single ended) transmission line. In accordance with the invention, it is also possible to achieve an impedance transformation at the same time. Impedance transformation means that the two ports will have different impedances. For example, a single ended port impedance of 50 Ohms can be transformed down to a very low balanced port impedance for use in push-pull amplifiers or transformed to a higher impedance to match certain antenna types. The configuration of couplers to form a balun in accordance with the invention allows for both transformations as well as some bandwidth adjustment.

Certain parameters must be defined and then others wll be calculated. For this balun circuit, both port impedances must be defined as well as what Z0en can be achieved. Bandwidth is a function of the port impedances and Z0en. The higher the value of Z0en that can be achieved the greater the bandwidth. Usually the port impedances and the bandwidth that are required are known. In this case, a graph (shown later) can be used to determine the value of Z0en required. Once these values are known, the characteristic impedance (Z0) of the couplers can be calculated.

For example, if the value of Z0en is 2.414 (3 dB coupler). The exact expression for Z0as a function of Zb is:

$$Z0=Zb/2*(Zb/Zs)^{1/2} \quad (13)$$

$$=Zb^{1/2}*Zs^{1/2}/2$$

$$\text{and with } Zs=50 \text{ Ohms} \quad =(Zb*12.5)^{1/2}$$

Simulating this circuit for a range of values for Zb shows that bandwidth is also a function of Zb. We have determined that Z0en also has a significant impact on bandwidth. Bandwidth peaks at a value of Zb that is slightly higher than the value of Zs and rolls off on both sides of this symmetrically relative to percentage of Zb. The difference between Zb and Zs at the bandwidth peaks varies with Z0en. The higher Z0en the closer Zb is to Zs at these bandwidth peaks.

Figure 9:
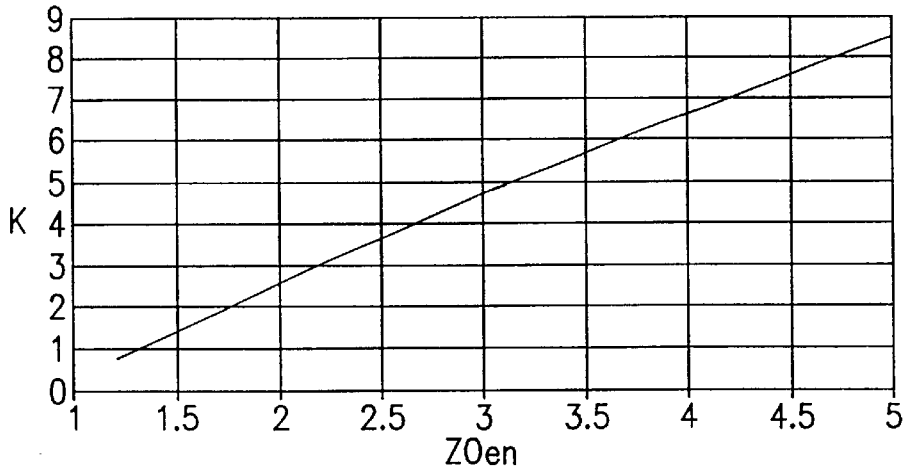
FIG. 9 is a plot of f(Z0en)

Each time Z0en is changed, a new Z0is required to maintain impedance match at the ports. So, a relationship between Z0, Zb and Z0en was found using the steps of the procedure outlined below:

1.) Set port 1 impedance (Zs) to 50 Ohms.
2.) Set port 2 impedance (Zb) to a fixed value.
3.) Simulate the circuit setting $Z0=k * Zb^{1/2}$ and step through values of Z0en and adjust k at each step so that the ports are impedance matched. Record the values of k for each Z0en.
4.) Calculate the polynomial line fit for k vs. Z0en. This is defined as f(Z0en). A plot of this function can be seen in FIG. 9.

The value of Z0 that provides impedance match at band center is a function of Zb and k as described in step 3 above. Replacing k with f(Z0en), the polynomial line approximation from step 4, leads to the following:

$$Z0m=f(Z0en)*Zb^{1/2} \text{ (with Zs=50 Ohms)} \quad (14)$$

$$f(Z0en)=0.03128*Z0en^3-0.35590*Z0en^2+3.2509*Z0en-2.6787 \quad (15)$$

Where f(Z0en) is a $3^{rd}$ order polynomial line approximation with an error of less than 0.1% for $2 \leqq Z0en \leqq 4$. Note that f(Z0en) can be reduced to the first order polynomial ($2*Z0en-4/3$) for an error of less than 1.0% over the same range.

Figure 10:
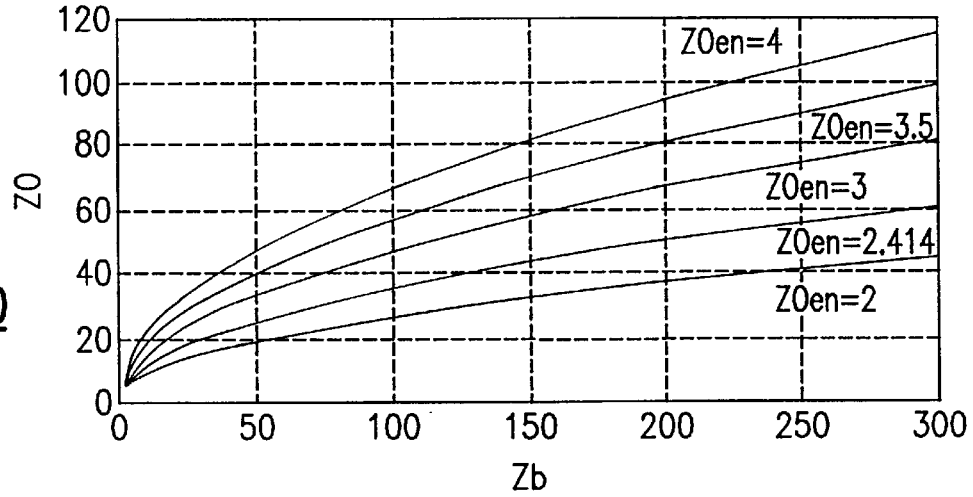
FIG. 10 is a graph of Z0versus zb for various values of Z0en.
Figure 11:
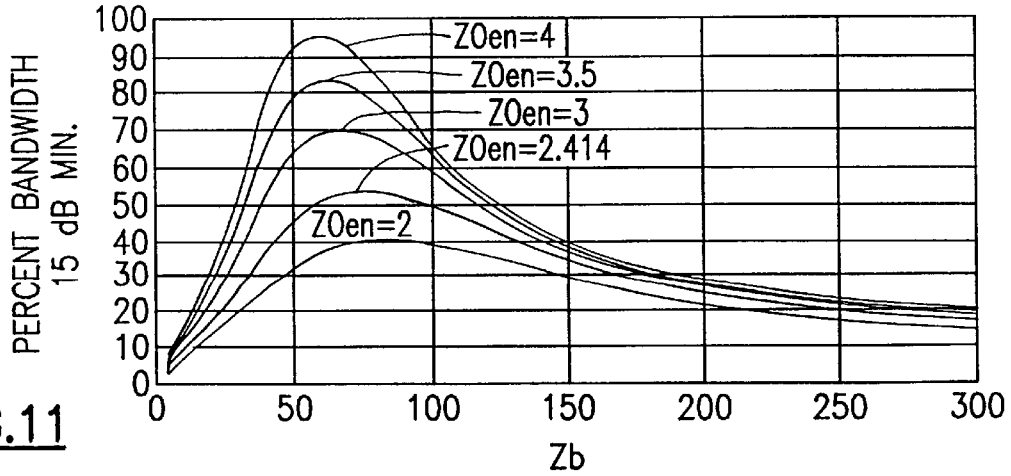
FIG. 11 is a plot of percent bandwidths as a function of zb for various values of Z0en.

Z0m varies with the square root of Zb. Another way of stating this is that Zb varies as the square of Z0 which means small changes in Z0 produce larger changes in Zb. So, this circuit offers a sort of "leverage" between coupler impedance (Z0) and the ratio of impedance transformation. FIG. 10 is a plot of Equation (14) for several values of Z0en. FIG. 11 is a plot of bandwidth (defined as 15 dB return loss) for the same conditions. These plots were generated with circuit simulation results. As mentioned earlier, the bandwidth does peak at a certain value of Zb and more bandwidth is available when greater values of Z0en can be achieved.

Figure 12:
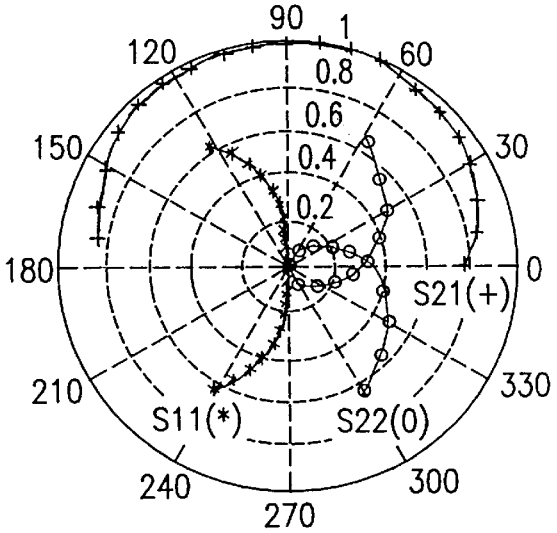
FIGS. 12–14 are graphical representations of Sd11 and Sd22 for different values of Z0.
Figure 13:
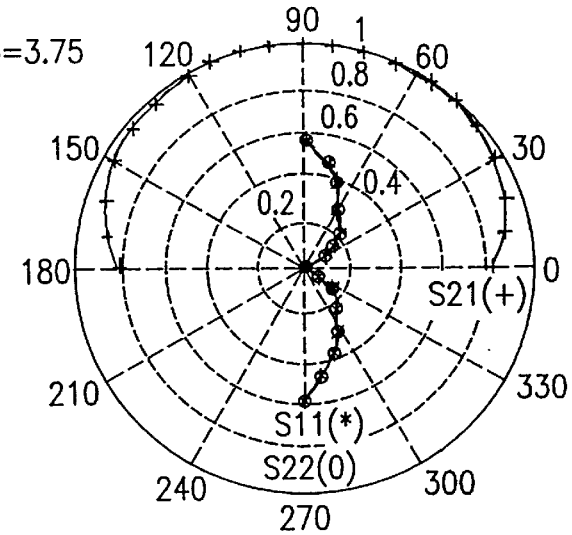
Figure 14:
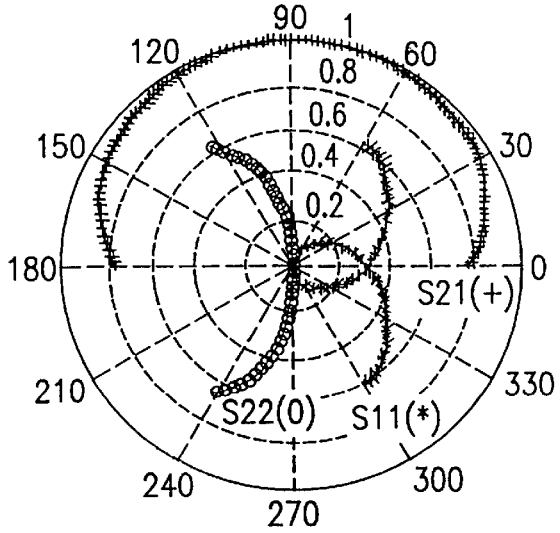

An interesting effect of this circuit can be observed when $S^d11$ and $S^d22$ are compared for different values of Zb. This effect can be illustrated by selecting Zb at the bandwidth peak and two other values that are an equal percentage above and below. Data plotted in FIGS. 12–14 show that there is a "flip" in the $S^d11$ and $S^d22$ response as Zb transitions through the bandwidth peak. Zb was selected to be 75 Ohms which is where the peak bandwidth occurs when Zs is 50 Ouns and Z0en is 2.414 (FIG. 13). Then Zb was set to 37.5 and 150 Ohms (and Z0 adjusted). Plots for these two conditions can be seen in FIGS. 12 and 14. Notice that the $S^d11$ data in FIG. 12 is the same as the $S^d22$ data in FIG. 14. Also, the $S^d22$ data in FIG. 12 is the same as the $S^d11$ data in FIG. 14.

Equation (14) can also be normalized to any single ended port impedance (port 1) by the following rational: In equation (14), f(Z0en) replaced the "$Zs^{1/2}/2$" term in line two of equation (13). But when the polynomial f(Z0en) was found, Zs was set to 50 Ohms. Dividing the f(Z0en) term of equation (14) by $50^{1/2}$ and multiplying by $Zs^{1/2}$ will generalize the expression for Z0 (equation (16)). Finally, a normalized expression can be obtained by dividing both sides by Zs (equation (17)).

$$\text{Generalized } Z0m=Zs^{1/2}*Zb^{1/2}*f(Z0en)/50^{1/2} \quad (16)$$

$$\text{Normalized } \frac{Z0m}{Zs} = \frac{Zs^{1/2} * Zb^{1/2} * f(Z0en)/50^{1/2}}{Zs} = (Zb/Zs)^{1/2} * \frac{f(Z0en)}{50^{1/2}}$$

Referring back to FIG. 1, a balun formed from a pair of couplers selected as just described is illustrated in block diagram form. The balun includes preferably identical symmetrical backward wave couplers 10 and 10'. While the couplers 10 and 10' would normally be identical couplers, the invention is not so limited, and the couplers may be of different designs, so long as they are selected as described above. The unbalanced input to the balun is connected between the input port and the direct port of coupler 10. The coupled port of coupler 10 is connected to the input port of coupler 10'. The balanced port of the balun is connected between the isolated port of coupler 10 and the direct port of coupler 10'. The coupled port and the isolated port of coupler 10' are grounded.

Figure 17:
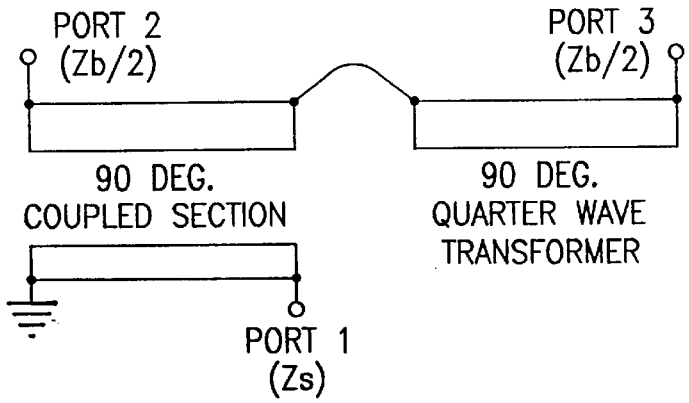
FIG. 17 is a schematic diagram of an alternative embodiment of the invention in which one of the couplers is a transmission line segment.

In accordance with one embodiment of the invention, one of the couplers 10 is a quarter wave section of transmission line with a characteristic impedance selected as described above for a coupler.Such a balun is shown in FIG. 17.

While the invention has been described in connection with several presently preferred embodiments thereof, those skilled in the art will recognize that many modifications and changes may be made therein without departing from the true spirit and scope of the invention which accordingly is intended to be defined solely by the appended claims.

What is claimed is:

1. A balun having an unbalanced port and a balanced port comprising:

first and second symmetrical backward wave couplers, each coupler including:
an input port;
a direct port
a coupled port; and
an isolated port;
the input port of the first coupler connected to the balun unbalanced port;
the coupled port of the first coupler connected to the input port of the second coupler; and
the isolated port of the first coupler and the direct port of the second coupler connected to the balun balanced port.

2. The balun of claim 1 in which the direct port of the first coupler, the coupled port and the isolated port of the second coupler are each connected to ground.

3. The balun of claim 1 in which the first and second couplers are substantially identical.

4. The balun of claim 1 in which the couplers are stripline couplers.

5. The balun of claim 4 in which the stripline couplers comprise first and second stripline segments separated by a first spacing and first and second groundplanes spaced from the first and second striplines by a second spacing greater than the first spacing.

6. The balun of claim 5 in which the stripline couplers are surface mount couplers.

7. The balun of claim 1 in which the couplers are wireline couplers.

8. The balun of claim 1 in which the couplers are transmission line couplers.

9. The balun of claim 1 in which the couplers are coax couplers.

10. The balun of claim 1 in which the couplers are microstrip couplers.

11. The balun of claim 1 in which the couplers are waveguide couplers.

12. A method for selecting a symmetrical backward wave coupler for a balun as described in claim 1 comprising:

selecting a desired balanced port impedance;

selecting a desired unbalanced port impedance;

determining Z0en for the symmetrical backward wave couplers;

calculating f(Z0en) according to the relationship:

$$f(Z0en)=0.03128*Z0en^3-0.35590*Z0en^2+3.2509*Z0en-2.6787$$

calculating Z0m according to the relationship:

$$Z0m=Zs^{1/2}*Zb^{1/2}*f(Z0en)/50^{1/2}.$$

13. A method for forming a balun having a balanced port and an unbalanced port from first and second symmetrical backward wave couplers each coupler including:

an input port;

a direct port a coupled port; and an isolated port;

comprising the steps of:

selecting a desired balanced port impedance;

selecting a desired unbalanced port impedance;

determining Z0en for the symmetrical backward wave couplers;

calculating f(Z0en) according to the relationship:

$$f(Z0en)=0.03128*Z0en^3-0.35590*Z0en^2+3.2509*Z0en-2.6787$$

calculating Z0m according to the relationship:

$$Z0m\ Zs^{1/2}*Zb^{1/2}*f(Z0en)/50^{1/2}$$

fabricating the first and second couplers defined by the calculated values of and;

connecting the input port of the first coupler to the balun unbalanced port;

the coupled port of the first coupler to the input port of the second coupler; and the isolated port of the first coupler and the direct port of the second coupler connected to the balun balanced port.

14. A balun having an unbalanced port and a balanced port comprising:

first and second symmetrical couplers, each coupler including:

an input port;

a direct port a coupled port; and an isolated port;

the input port of the first coupler connected to the balun unbalanced port;

the coupled port of the first coupler connected to the input port of the second coupler; and the isolated port of the first coupler and the direct port of the second coupler connected to the balun balanced port.

15. The balun of claim 14 in which the direct port of the first coupler, the coupled port and the isolated port of the second coupler are each connected to ground.

16. The balun of claim 14 in which the first and second couplers are substantially identical.

17. The balun of claim 14 in which the couplers are stripline couplers.

18. The balun of claim 17 in which the stripline couplers comprise first and second stripline segments separated by a first spacing, and first and second grounldplanies spaced from the first and second striplines by a second spacing greater than the first spacing.

19. The balun of claim 14 in which the couplers are waveguide couplers.

20. The balun of claim 14 in which the couplers are wireline couplers.

21. The balun of claim 14 in which the couplers are transmission line couplers.

22. The balun of claim 14 in which the couplers are coax couplers.

23. The balun of claim 14 in which the couplers are microstrip couplers.

24. The balun of claim 14 in which the stripline couplers are surface mount couplers.

25. A balun having an unbalanced port and a balanced port comprising:

a first symmetrical backward wave coupler including:

an input port;

a direct port a coupled port; and an isolated port; and a ½ wave transformer having and input and an output;

the input port of the coupler connected to the balun unbalanced port;

the coupled port of the first coupler connected to the input port of the transformer; and the isolated port of the first coupler and the output of the transformer connected to the balun balanced port.

26. The balun of claim 25 in which the direct port of the coupler is connected to ground.

27. The balun of claim 25 in which the coupler and the transformer are a stripline coupler and a stripline transformer.

28. The balun of claim 27 in which the stripline coupler comprises first and second stripline segments separated by a first spacing and first and second groundplanes spaced from the first and second striplines by a second spacing greater than the first spacing.

29. The balun of claim 27 in which the stripline couplers are surface mount couplers.

30. The balun of claim 25 in which the coupler and the transformer are a wireline coupler and a wireline transformer.

31. The balun of claim 25 in which the coupler and the transformer are a transmission line coupler and a transmission line transformer.

32. The balun of claim 25 in which the coupler and the transformer are a coax coupler and a coax transformer.

33. The balun of claim 25 in which the coupler and the transformer are a microstrip coupler and a microstrip transformer.

34. The balun of claim 25 in which the coupler and the transformer are a waveguide coupler and a waveguide transformer.

* * * * *